United States Patent [19]

Pfefferkorn et al.

[11] 4,081,720

[45] Mar. 28, 1978

[54] STOPPER DEVICE

[76] Inventors: Hans Pfefferkorn, Beethovenstrasse 19, 654 Simmern; Bernd Pfefferkorn, Gass 9, 6541 Kulz; Viktor Reiter, An der Schneiderburg, 654 Simmern, all of Germany

[21] Appl. No.: 816,105

[22] Filed: Jul. 15, 1977

[30] Foreign Application Priority Data

Apr. 2, 1977 Germany ..... 7710510[U]

[51] Int. Cl.[2] ..... B65D 41/60

[52] U.S. Cl. ..... 215/354; 215/364

[58] Field of Search ..... 215/320, 354, 364

[56] References Cited

U.S. PATENT DOCUMENTS 1,989,218 1/1935 Villanyi ..... 215/364

3,995,762 12/1976 Pfefferkorn et al. ..... 215/320 X

*Primary Examiner*—Donald F. Norton

*Attorney, Agent, or Firm*—Erwin Salzer

[57] ABSTRACT

This invention relates to stopper devices, particularly stopper devices for closing bottles containing wine. It includes two parts, namely a hollow body of synthetic material defining a cavity open at the top and closed at the bottom and having a fluted flange at the upper end thereof. A bottle cap is mounted on said fluted flange and engages the flutes thereof to preclude relative rotary motion between said flange and said cap. The wall of said body of synthetic material includes an upper bulging portion and a lower cylindrical portion and a cylindrical stopper of cork is press-fitted into said lower cylindrical portion.

2 Claims, 2 Drawing Figures

STOPPER DEVICE

BACKGROUND OF THE INVENTION

This invention relates to an improvement of the stopper device disclosed and claimed in U.S. Pat. No. 3,995,762; 12/07/76 to Pfefferkorn et al for BOTTLE STOPPER MEANS FOR WINE BOTTLES and similar devices.

It has been found that a stopper of cork is pressed more strongly against the neck of a bottle, or the like, than a stopper of an elastomer, thus eliminating tolerances in regard to the inner diameter thereof. If the stopper material does not get in contact with the liquid inside the bottle, low grade cork may be used which is cheaper than rubber, or other elastomers. It has also been found that inserts of rubber affect the flavor of wine to some extent, even if they do not get in contact with the latter.

SUMMARY OF THE INVENTION

A stopper device according to this invention includes a hollow body of a synthetic material defining a cavity open at the top and closed at the bottom thereof, and having a fluted flange at the upper end thereof. A cap is mounted on said fluted flange and engages the flutes thereof to preclude any relative rotary motion between said flange and said cap. The wall of said body of synthetic material includes an upper bulging portion and a lower cylindrical portion and a cylindrical stopper of cork is press-fitted into said lower portion.

DESCRIPTION OF PREFERRED EMBODIMENT

Figure 1:
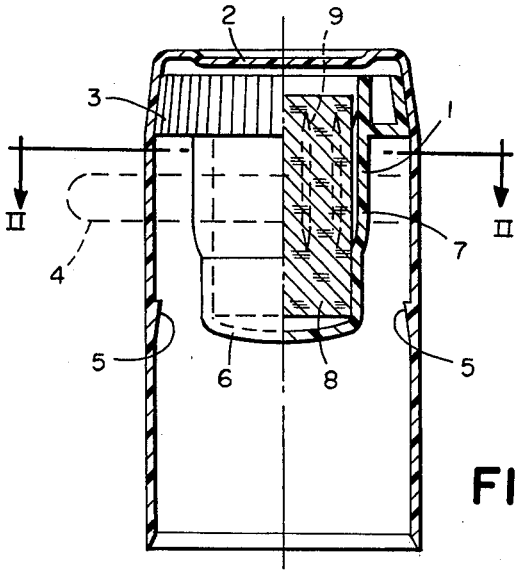
FIG. 1 is partly a side elevation of and partly a vertical section through a stopper device embodying the present invention.

Referring now to the drawings, numeral 1 has been applied to indicate a body of synthetic material, or of a synthetic resin, defining a cavity open at the top and closed at the bottom thereof. The body 1 is provided with a flange 3 at the upper end thereof which is fluted. A cap 2 of suitable material, e.g. of a synthetic resin, is mounted on body 1 and engages the flutes in flange 3 so as to preclude any relative rotary motion between flange 3 and cap 2. The upper portion of cap 2 may be separated from the lower fluted portion of cap 2 by a tab 4 adapted to be torn off, and thus allowing to get access to the contents of the bottle. The projections 5 on the bottle preclude removal of cap 2 without severing of the same by tab 4.

Figure 2:
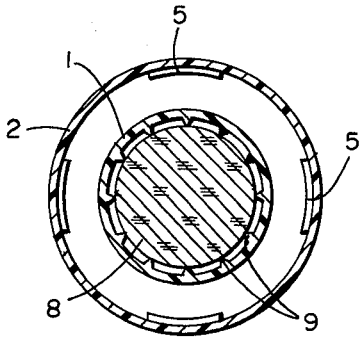
FIG. 2 is a section along II—II of FIG. 1.

The wall body 1 includes an upper bulging portion 7 and a lower cylindrical portion 6 and the cylindrical stopper of cork 8 is press-fitted into said upper and lower portions 7,6. The internal wall of the bulging portion 7 is provided with spaced ribs 9 which extend in a direction longitudinally of the neck of the bottle. Ribs 9 are of such a height that they penetrate into the surface of said cylindrical stopper 8 of cork, as clearly shown in FIG. 2. The elasticity of cork stopper 8 compensates for tolerances of the diameter of the bottle neck, i.e. variations of the inner diameter thereof and allows repeated safe openings and closings of the bottle.

We claim as our invention:

1. A stopper device, particularly for wine bottles, comprising a hollow body of synthetic material defining a cavity open at the top and closed at the bottom thereof and having a fluted flange at the upper end thereof, and a cap mounted on said fluted flange and engaging the flutes thereof to preclude any relative rotary motion between said flange and said cap characterized in that the wall of said body includes an upper bulging portion and a lower cylindrical portion and that a cylindrical stopper of cork is press-fitted into said upper and said lower portions.

2. A stopper device as specified in claim 1 wherein said bulging portion is provided on the inner surface thereof with spaced ribs extending in a direction longitudinally of the neck of the bottle and being of such height that they penetrate into the surface of said cylindrical stopper of cork.

* * * * *